US005310105A

United States Patent [19]

Mills

[11] Patent Number: 5,310,105

[45] Date of Patent: May 10, 1994

[54] STOCK MATERIAL STRIP FEED CONTROLLER

[76] Inventor: William D. Mills, 11105 Frederick Pike, Vandalia, Ohio 45377

[21] Appl. No.: 63,125

[22] Filed: May 17, 1993

Related U.S. Application Data

[63] Continuation of Ser. No. 667,574, Mar. 11, 1994, abandoned.

[51] Int. Cl.[5] ..... B65H 23/04

[52] U.S. Cl. ..... 226/24; 226/27; 226/35; 226/44; 226/118

[58] Field of Search ..... 226/24, 27, 195, 38, 226/32, 39, 44, 45, 34, 35, 140, 162, 165, 118, 117

[56] References Cited

U.S. PATENT DOCUMENTS

| | | | |
|---|---|---|---|
| 3,393,589 | 7/1968 | Mills | 83/13 |
| 3,406,601 | 10/1968 | Clifford | 83/72 |
| 3,481,520 | 12/1969 | Pickering | 225/4 |
| 3,670,614 | 6/1972 | Streckert | 83/208 |
| 3,709,078 | 1/1973 | Mills | 83/226 |
| 3,734,368 | 5/1973 | Kudelski | 226/195 X |
| 3,788,534 | 1/1974 | Shumaker | 226/39 X |
| 3,819,097 | 6/1974 | Stritzko | 226/39 |
| 3,972,211 | 8/1976 | Linthicum et al. | 83/80 X |
| 4,183,271 | 1/1980 | Martin | 83/156 |
| 4,561,581 | 12/1985 | Kelly | 226/24 X |
| 4,633,742 | 1/1987 | Gutowski et al. | 83/13 |
| 4,809,188 | 2/1989 | Willits et al. | 226/28 X |

FOREIGN PATENT DOCUMENTS

| | | | |
|---|---|---|---|
| 0123063 | 5/1990 | Japan | 226/38 |

OTHER PUBLICATIONS

"New Drive Gives Positive Press Feed Control," Metal Forming (Jan. 1991).

Mills, Inc. Brochure entitled, "Introducing Accufeed," distributed after May 24, 1990.

Mills, Inc. Brochure entitled, "Accurate Feeding Boosts Press Production," distributed after May 24, 1990.

*Primary Examiner*—Daniel P. Stodola

*Assistant Examiner*—Paul T. Bowen

*Attorney, Agent, or Firm*—Killworth, Gottman, Hagan & Schaeff

[57] ABSTRACT

An apparatus for measuring and controlling lengths of movement of a continuous stock material strip which is intermittently fed by feed rollers along a predetermined path of travel to a machine which includes a reciprocally operable carriage having tooling for acting upon the strip. The apparatus comprises a strip measuring mechanism for engaging with and sensing a length of movement of the strip and generating a first signal representative of the length of movement of the strip. A controller receives the first signal from the strip measuring mechanism, and comparing the first signal to a second signal representative of a predetermined desired length of movement of the strip. The controller generates a shut-down signal to the machine if the difference between the first and second signals exceeds a predetermined shut-down limit range and generates a length error signal representing the difference between the first and second signals. A bridge mechanism is connected to the controller and can be manually or automatically controlled for adjusting the succeeding lengths of movement of the strip based upon the length error signal.

14 Claims, 10 Drawing Sheets

STOCK MATERIAL STRIP FEED CONTROLLER

This application is a continuation of application Ser. No. 07/667,574, filed Mar. 11, 1991, now abandoned.

BACKGROUND OF THE INVENTION

This invention relates to an apparatus for measuring the length of movement of a continuous stock material strip which is intermittently fed to a press by feed rollers and, more particularly, to such an apparatus which includes a bridge assembly for correcting successive lengths of movement of the intermittently fed stock material strip by varying the distance the strip travels from the feed rollers to the press.

Apparatus has been employed in the prior art for determining a length of movement of a strip of material as the strip is intermittently fed by feed rollers into a press. For example, U.S. Pat. No. 3,709,078 discloses an apparatus for sensing the length of movement of an intermittently fed strip of material. The apparatus comprises rotor means including a shaft which rotatably supports two wheels that engage the strip of material. Intermediate the ends of the shaft is a rotor which includes a conductor section and an insulator section. A plurality of brushes are provided for sensing the rotative position of the rotor, thereby providing an indication of the length of movement of the strip. Also provided on the shaft is a collar having an opening therein. A spring-biased plunger is provided which is engageable with the opening in the collar when the press closes. If the strip of material has been fed a correct distance, the opening in the collar will be positioned directly in alignment with the plunger which will move freely into the opening when the press closes. If, however, the strip has been fed a distance either slightly farther or less than intended, the opening in the collar will be slightly out of alignment with the plunger. Thus, when the press closes, the plunger will be forced into the opening in the collar, thereby rotating the shaft and the wheels positioned thereon. Rotation of the wheels is intended to move the strip so as to correctly position the strip in the press. It has been found, however, that slippage occurs between the wheels and the strip as the shaft begins to rotate causing inaccurate correction of the position of the strip. The apparatus has also been found to be disadvantageous since an operator must engage in a tedious, time consuming operation of changing the wheels on the shaft each time a different length of feed is desired.

Accordingly, there is a need for an accurate and easily operable apparatus for measuring and controlling lengths of movement of a continuous stock material strip which is intermittently fed to a press by a set of feed rollers.

SUMMARY OF THE INVENTION

This need is met by the apparatus of the present invention which serves to measure a length of movement of a continuous stock material strip which is intermittently fed to a press by feed rolls, and serves to correct successive lengths of movement of the intermittently fed stock material strip by varying the distance the strip travels from the feed rollers to the press. The apparatus includes a roller and encoder assembly which serves to engage and sense lengths of movement of the strip. The roller and encoder are mounted in a reciprocating assembly so as to permit the roller to disengage the strip after measuring each length of movement of the strip. Also provided is a bridge, which is positioned between the reciprocating assembly and the feed rollers, for correcting successive lengths of movement of the intermittently fed stock material strip by varying the distance the strip travels from the feed rollers to the press.

In accordance with a first aspect of the present invention, an apparatus is provided for measuring the movement of a continuous intermittently advanced stock material strip. The apparatus includes a base having a guide surface over which the strip travels. A support is positioned adjacent to the base and is movable relative thereto. Reciprocating means are associated with the support for reciprocally moving the support between a first position adjacent to the guide surface and a second position away from the guide surface. Rotatable sensor means are mounted to the support for sensing the movement of the strip. The rotatable sensor means engages the strip for sensing strip movement when the support is in the first position and is removed from the strip when the support is in the second position.

The reciprocating means comprises a cam having a first pin fixedly connected thereto and an outer camming surface positioned on its outer periphery. The cam is pivotably connected to the support via a second pin. Roller means are associated with the base for engaging with the outer camming surface of the cam. Actuating means are provided for acting upon the first pin to rotate the cam about the second pin, thereby causing the outer camming surface to travel over the roller means to reciprocally move the support between the first and second positions.

The roller means comprises a first roller rotatably mounted to a shaft, and a housing having first and second outer surfaces, and an opening for receiving the first roller. The shaft is mounted within the opening of the housing so that the first roller extends out from the first surface an amount greater than it extends out from the second surface. The base includes a first recess for removably receiving the roller means.

The actuating means comprises a bar slidably positioned in a second recess in the support for reciprocating movement therein. The bar includes a slot for receiving the first pin. When the bar reciprocates in the second recess, the slot acts upon the first pin to rotate the cam about the second pin.

The base includes a guide roller which extends above the guide surface for engaging the strip as it travels over the guide surface. The rotatable sensor means includes a sensing roller having a knurled surface which engages the strip. The sensing roller and the guide roller are positioned diametrically opposite to one another and are forced apart by the strip as it passes therebetween.

The sensing roller engages and rotates with the strip when the support is in the first position. Encoder means are associated with the sensing roller for generating a series of pulses which are representative of the movement of the strip. Counter means are provided for counting the pulses to accumulate a count representative of the movement of the strip. Resilient biasing means are also provided for biasing the support toward the base.

In accordance with a second aspect of the present invention, an apparatus is provided for measuring and controlling lengths of movement of a continuous stock material strip which is intermittently fed by feed rollers along a predetermined path of travel to a machine which is provided with a reciprocally operable carriage having operation means for acting upon the strip. The apparatus comprises strip measuring means for engaging with and sensing a length of movement of the strip and generating a first signal representative of the length of movement of the strip. Controller means are provided for receiving the first signal from the strip measuring means, and comparing the first signal to a second signal representative of a predetermined desired length of movement of the strip. The controller means generates a shut-down signal to the machine if the difference between the first and second signals exceeds a predetermined shut-down limit range and generates an error signal if the difference between the first and second signals does not exceed the shut-down limit range but exceeds a predetermined error limit range. Strip adjustment means are connected to the controller means and are responsive to the error signal for adjusting the next successive length of movement of the strip based upon the error signal.

The controller means further includes means for inputting the shut-down limit range and the error limit range. The strip measuring means may comprise a sensing roller, and encoder means as discussed above with respect to the first aspect of the present invention. The strip adjustment means comprises a bridge positioned below the path of travel of the strip. The bridge is movable toward and away from the strip. Lifting means are associated with the bridge for reciprocally moving the bridge between a lowered position and an elevated position. The bridge acts to raise the strip as it moves from its lowered position to its elevated position. Height adjustment means are positioned adjacent to the bridge and lifting means for adjusting the height of the bridge and the lifting means in response to the error signal, thereby changing the distance the strip must travel from the feed rollers to the machine.

In accordance with a third aspect of the present invention, an apparatus is provided for measuring and controlling lengths of movement of a continuous stock material strip which is intermittently fed by feed rollers along a predetermined path of travel to a machine which is provided with a reciprocally operable carriage having operation means for acting upon the strip. The apparatus comprising strip measuring means for sensing a length of movement of the strip and generating a first signal representative of the length of movement of the strip. Controller means are provided for receiving the first signal from the strip measuring means, and comparing the first signal to a second signal representative of a predetermined desired length of movement of the strip. The controller means generates a shut-down signal to the machine if the difference between the first and second signals exceeds a predetermined shut-down limit range, thereby shutting down the machine and preventing damage from occurring to the operation means before the operation means acts upon the strip.

The controller means further includes display means for displaying a length error equal to the difference between the first and second signals. The apparatus further comprises strip adjustment means for correcting successive lengths of movement of the strip. In a first embodiment of the present invention, the strip adjustment means is manually adjustable in response to the displayed length error. In a second embodiment of the present invention, the strip adjustment means is adjustable in response to an error signal generated by the controller means if the difference between the first and second signals does not exceed the shut-down limit range but exceeds a predetermined error limit range.

The strip adjustment means in both the first and second embodiments comprises a bridge positioned below the path of travel of the strip and is movable toward and away from the strip. Lifting means are associated with the bridge for reciprocally moving the bridge between a lowered position and an elevated position. The bridge raises the strip as it moves from its lowered position to its elevated position. Height adjustment means are associated with the bridge and the lifting means for adjusting the height of the bridge and the lifting means, thereby changing the distance the strip must travel from the feed rollers to the machine. In the first embodiment, the height adjustment means is manually adjustable in response to the displayed length error. In the second embodiment, the height adjustment means is adjusted in response to the error signal generated by the controller means.

According to preferred embodiments, it is an object of the present invention to provide an apparatus for accurately and easily measuring and controlling lengths of movement of a continuous stock material strip which is intermittently fed to a press by a set of feed rollers. It is a further object of the present invention to provide an apparatus which serves to measure a length of movement of a continuous stock material strip which is intermittently fed to a press by feed rollers and corrects successive lengths of movement of the intermittently fed stock material strip by varying the distance the strip travels from the feed rollers to the press.

These and other objects and advantages of the invention will be apparent from the following description, the accompanying drawings and the appended claims.

DETAILED DESCRIPTION OF THE INVENTION

Figure 1:
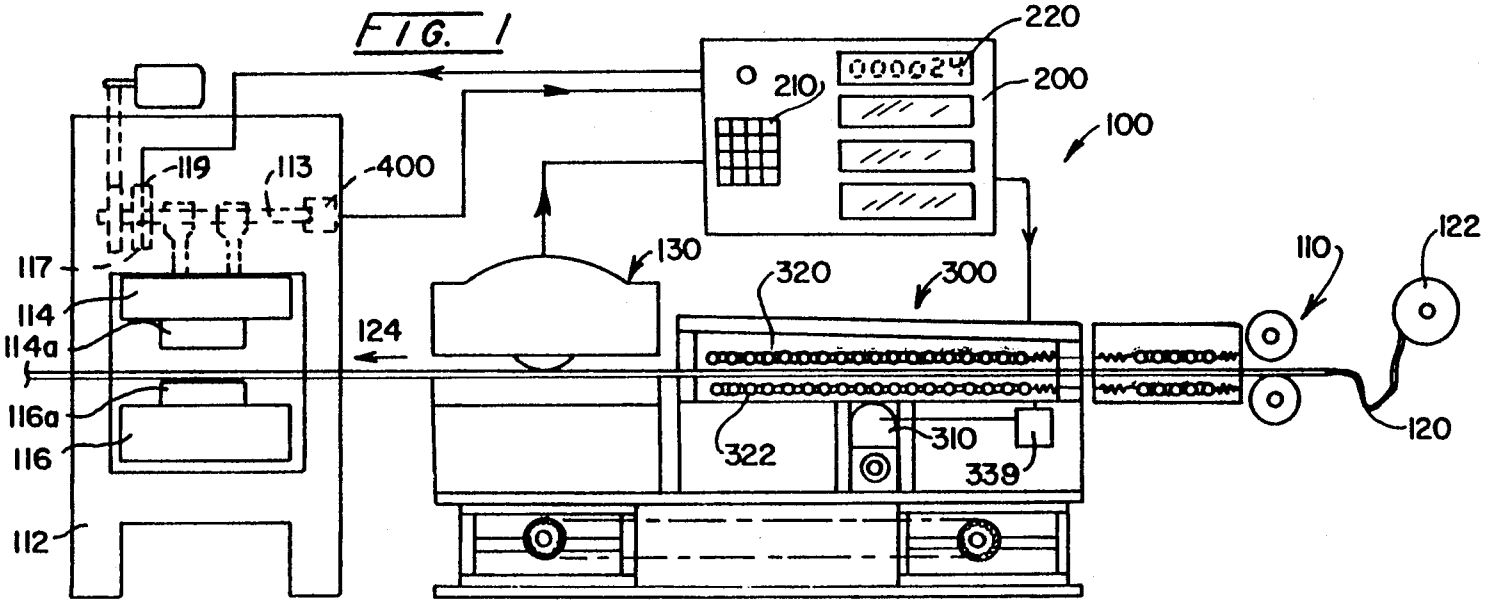
FIG. 1 is a schematic side view of a press including the stock material strip feed controller of the present invention.
Figure 2:
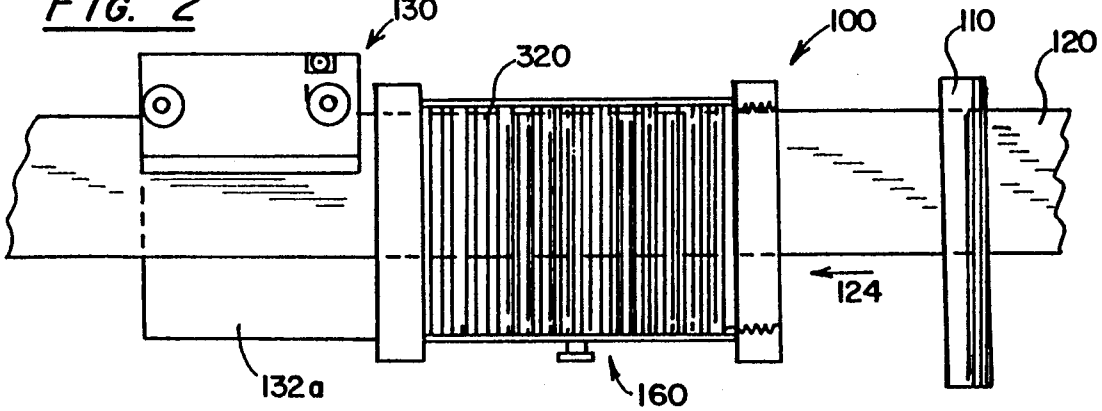
FIG. 2 is a plan view of the controller of FIG. 1.

According to the present invention, an apparatus 100 is provided for measuring and controlling lengths of movement of a continuous stock material strip. The apparatus 100 is shown in FIG. 1 positioned between a set of feed rolls 110 and a press 112. The feed rolls 110 serve to intermittently feed a stock material strip 120, supported by a drum 122, along a predetermined path 124 into the press 112. The feed rolls 110 are drivenly connected in a known manner by means (not shown) to the crankshaft 113 of the press 112, and can be adjusted so as to intermittently feed desired lengths of the strip 120 into the press 112. The press 112 includes a reciprocating slide 114 having upper tooling **114*a* mounted thereto, and a bolster 116 having lower tooling 116*a* mounted thereto. The slide 114 is caused to reciprocate relative to the bolster 116 by the crankshaft 113 so as to permit the upper tooling 114*a* to engage with the lower tooling 116*a* and act upon the strip 120**.

The measuring and controlling apparatus 100 comprises strip measuring means 130 for engaging and sensing a length of movement of the strip 120 and generating a first signal representative of the length of movement of the strip 120. The first signal is sent to a controller 200, which compares the first signal to a second signal representative of a predetermined desired length of movement of the strip 120. As will be discussed in greater detail below, the controller 200 generates a shut-down signal to the press 112 if the difference between the first and second signals exceeds a predetermined shut-down limit range and displays a length error equal to the difference between the first and second signals. Also provided is strip adjustment means 300 for adjusting successive lengths of movement of the strip 120 based upon the error signal. As will also be discussed below, the strip adjustment means 300 may be adjusted manually or automatically to adjust successive lengths of movement of the strip 120.

Figure 3:
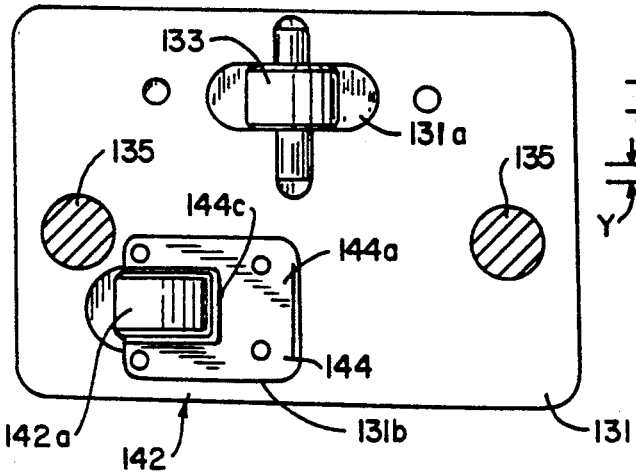
FIG. 3 shows the base of strip measuring apparatus of the present invention.
Figure 4:
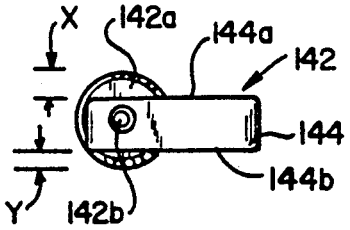
FIG. 4 is a side view of the adjustable roller means received within the base of FIG. 3.
Figure 5:
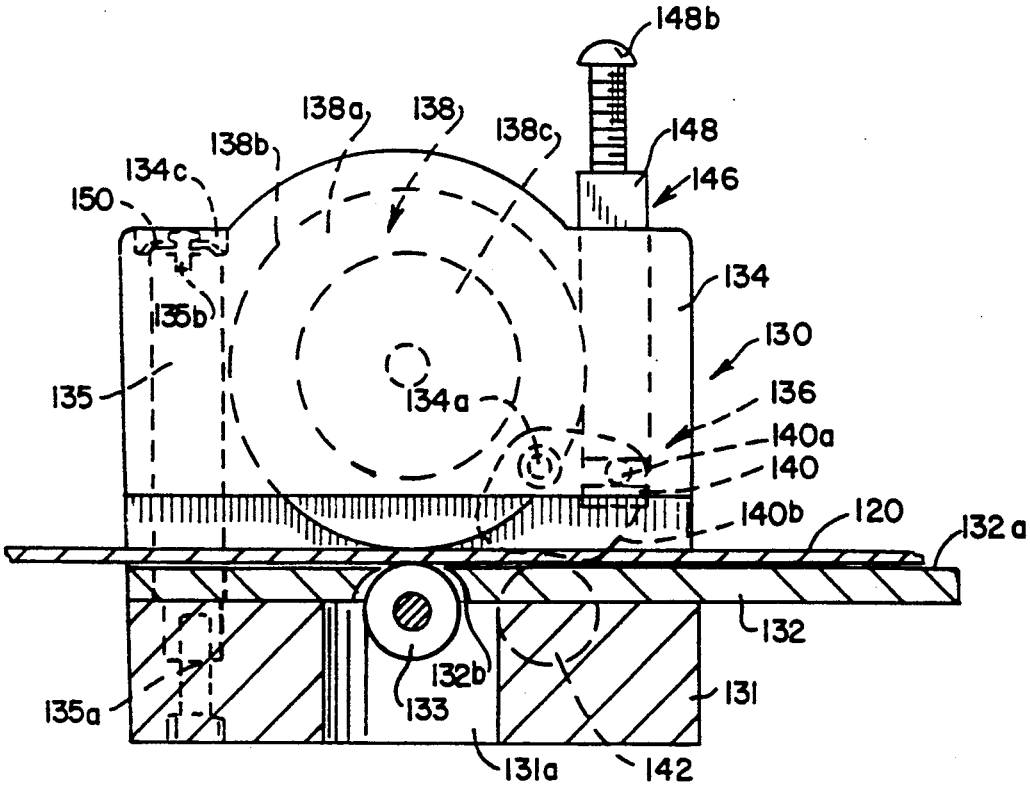
FIGS. 5 and 6 are partially sectioned front elevational views of the strip measuring apparatus of the present invention with one cylindrical column not shown.
Figure 6:
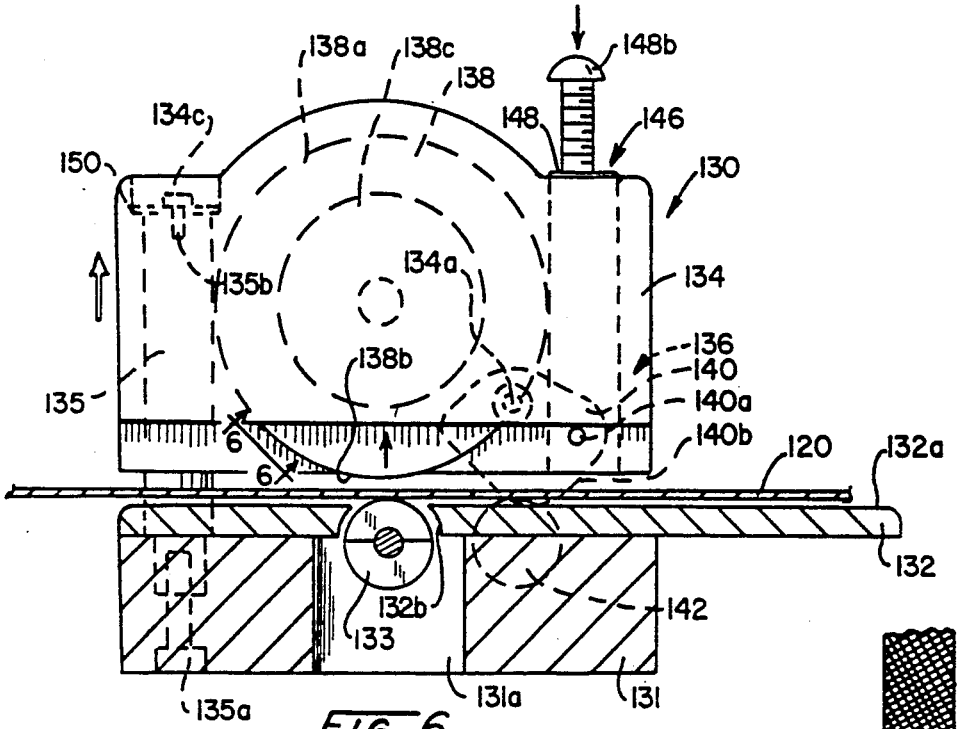
Figure 7:
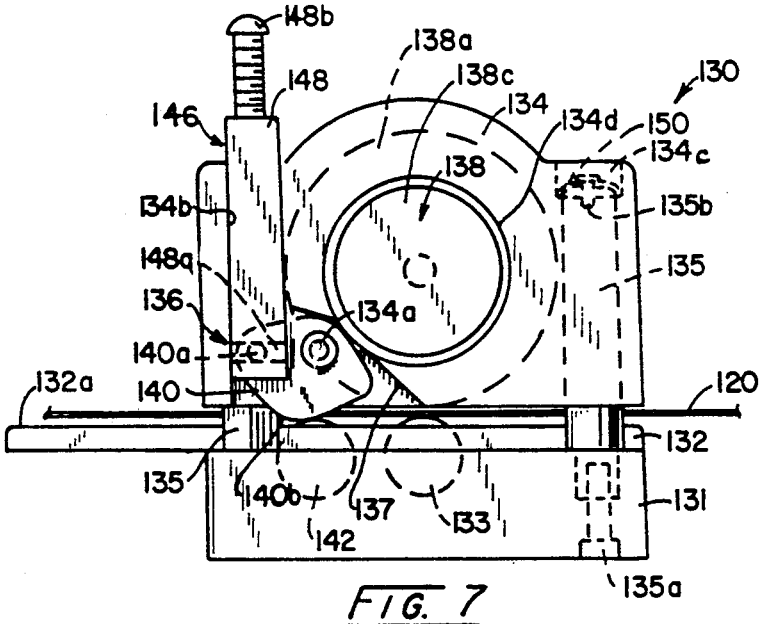
FIG. 7 is a rear elevational view of the strip measuring apparatus shown in FIGS. 5 and 6 with the support in the first position.
Figure 8:
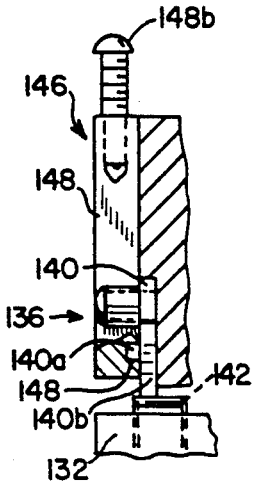
FIG. 8 is a partially broken-away/sectioned view of the reciprocating means of the strip measuring apparatus.
Figure 9:
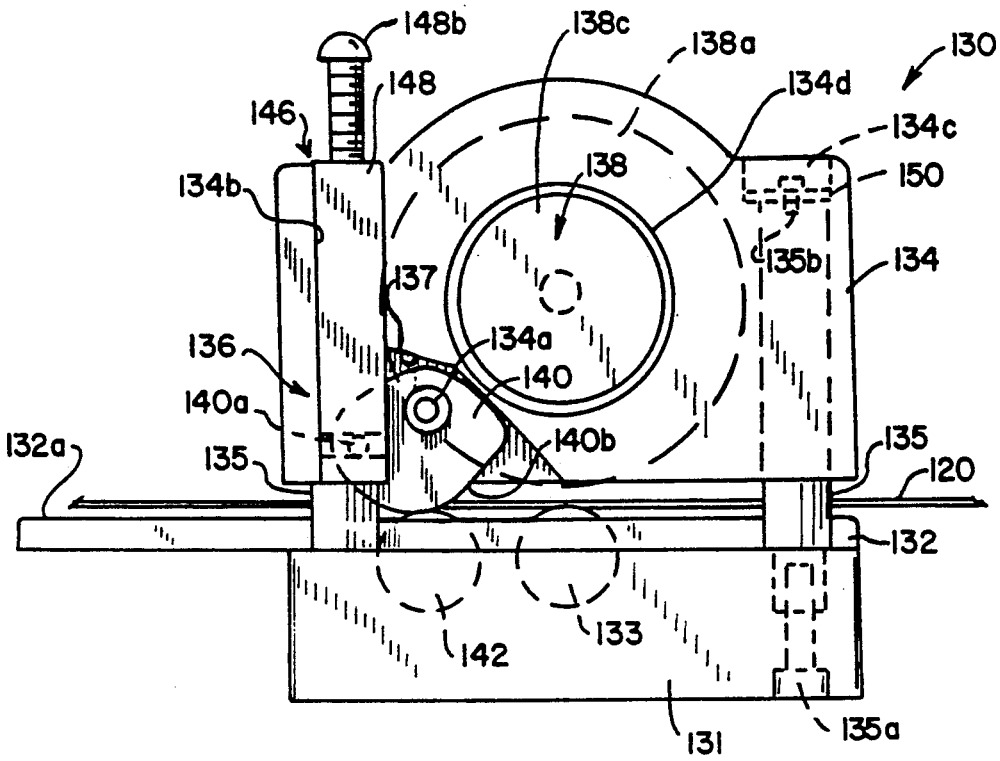
FIG. 9 is a rear elevational view of the strip measuring apparatus shown in FIGS. 5-7 with the support in the second position.

The strip measuring means 130, as best shown in FIGS. 3-9, includes a base 131 connected by bolts (not shown) to a guide plate 132 having an upper guide surface **132*a* over which the strip 120 travels. A guide roller 133 is mounted within a recess 131*a* in the base 131 and extends through an opening 132*b* in the guide plate 132 just above the guide surface 132*a* thereof for engaging the strip 120 as it travels over the guide surface 132*a*. A support 134 is positioned adjacent to the base 131 and is movable relative thereto on a pair of cylindrical columns 135, which are connected to the base 132 by screws 135*a* or the like. Reciprocating means 136 are associated with the support 134 for reciprocally moving the support 134 on the columns 135 between a first position adjacent to the guide surface 132*a*, as shown in FIGS. 5 and 7, and a second position away from the guide surface 132*a*, as shown in FIGS. 6 and 9. Rotatable sensor means 138 are also provided and are mounted to the support 134 for sensing the movement of the strip 120. The rotatable sensor means 138 engages the strip 120 for sensing strip movement when the support 134 is in the first position, and is removed from the strip 120 when the support 134** is in the second position.

As best shown in FIGS. 7-9, the reciprocating means 136 includes a cam 140 having a first pin **140*a* fixedly connected thereto and an outer camming surface 140*b* on its outer periphery. The cam 140 is positioned in a recess 137 in the support 134 and is pivotably connected to the support 134 via a second pin 134*a*. Roller means 142 are associated with the base 132 for engaging with the outer camming surface 140*b* of the cam 140. Actuating means 146 are further provided for acting upon the first pin 140*a* to rotate the cam 140 about the second pin 134*a*, thereby causing the outer camming surface 140*b* to travel over the roller means 142 to reciprocally move the support 134** between the first and second positions.

The roller means 142, as best shown in FIGS. 3 and 4, comprises a roller **142*a* rotatably mounted to a shaft 142*b*. A housing 144 is provided having first and second outer surfaces 144*a* and 144*b*, respectively, and an opening 144*c* for receiving the roller 142*a*. The shaft 142*b* is mounted within the opening 144*c* of the housing 144 so that the roller 142*a* extends out from the first surface 144*a* an amount X which is greater than the amount Y it extends out from the second surface 144*b*. The base 131 includes a recess 131*b* for removably receiving the roller means 142 therein. Because the roller 142*a* extends out from the first surface 144*a* an amount greater than it extends out from the second surface 144*b*, the distance between the support 134 and the guide surface 132*a* when the support 134 is in the first position can be varied by rotating the housing 144 in the recess 131*b*. The distance between the support 134 and the guide surface 132*a* can be further varied by shims selectively positioned under the housing 144**.

The actuating means 146 comprises a bar 148 slidably positioned in a recess **134*b* in the support 134 for reciprocating movement therein. The bar 148 includes a slot 148*a* for receiving the first pin 140*a* of the cam 140. The slot 148*a* acts upon the first pin 140*a* to rotate the cam 140 about the second pin 134*a* when the bar 148 reciprocates in the second recess 134*b*. A bolt 148*b* is threadedly connected to the bar 148. When the bolt receives a downwardly directed force by, for example, means (not shown) connected to the slide 114 of the press 112, it acts to translate the bar 148 downwardly, thereby raising the support 134 from the first position to the second position away from the guide surface 132*a*. While the press is the currently preferred source of an operating force for the cam 140**, other electrical, pneumatic or hydraulic drives may be preferred for given applications.

Biasing means, comprising spring washers 150, are provided for biasing the support 134 toward the guide surface **132*a*. At least one washer 150 is positioned in each recess 134*c* in the support 134 and is connected to one of the columns 135 by a bolt 135*b* or the like. After the reciprocating means 136 moves the support 134 from the first position to the second position, as shown in FIGS. 6 and 9, and is released, the spring washers 150 act to apply a downward force upon the support 134**, thereby moving the support to the first position, as shown in FIGS. 5 and 7.

Figure 6A:
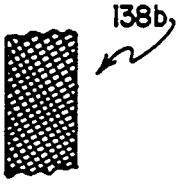
FIG. 6A shows the knurled outer peripheral surface of a sensing roller of the strip measuring apparatus of FIGS. 5 and 6 as viewed along a view line 6—6 of FIG. 6.

The rotatable sensor means 138 includes a sensing roller **138*a* which engages with the strip 120 when the support 134 is in the first position, and is removed from the strip 120 when the support 134 is in the second position. The sensing roller 138a has a knurled outer peripheral surface 138b as shown in FIG. 6A. The sensing roller 138a and the guide roller 133 are positioned diametrically opposite to one another, as shown in FIGS. 5 and 7, and engage the strip 120 as it passes therebetween. An encoder 138c is mounted in a recess 134d in the support 134 and is rotatably connected to the sensing roller 138a. The encoder 138c acts to generate a series of pulses which are representative of movement of the strip 120 and are transmitted to the controller 200 as the sensing roller 138a** rotates.

In operation, the sensing roller 138a and the encoder 138c act to sense strip movement when the support 134 is in the first position and generate a series of pulses to the controller 200 representative of strip movement. The support 134 is moved from the first position to the second position by the reciprocating means 136 after each length of movement of the strip 120 in order to disengage the sensing roller 138a from the strip 120. The biasing means 150 then forces the support 134 back to the first position, thereby resetting the sensing roller 138a on the strip 120. The step of disengaging the sensing roller 138a and resetting it upon the strip 120 is performed to prevent the knurled surface 138b on the sensing roller 138a from laterally translating the strip 120 away from the predetermined path of travel 124 of the strip 120.

Figure 10:
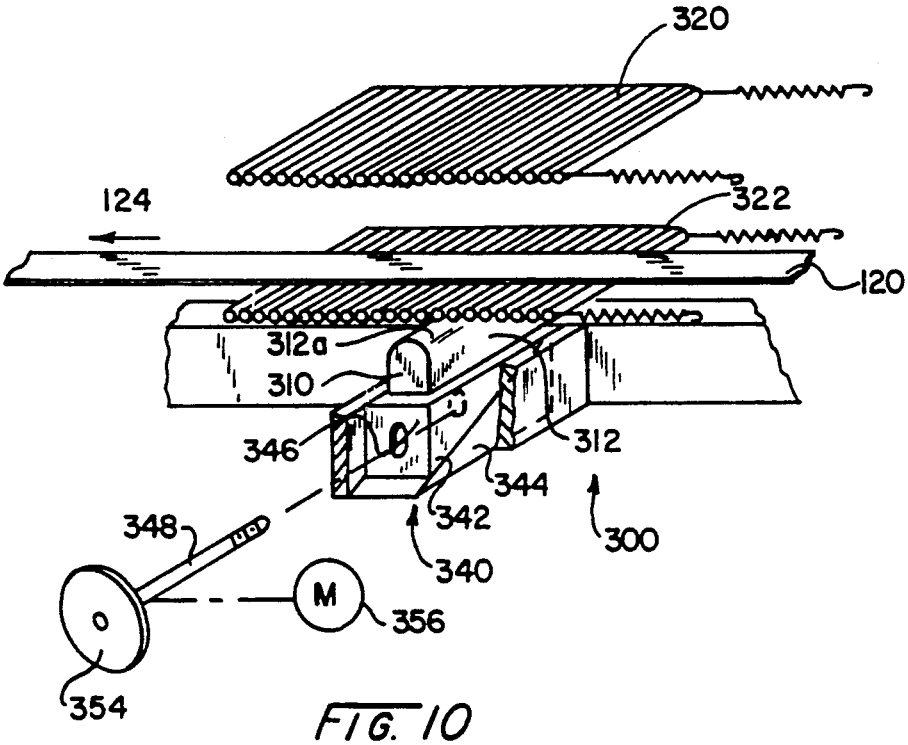
FIGS. 10 and 11 are perspective views of strip adjustment apparatus usable in the present invention.
Figure 11:
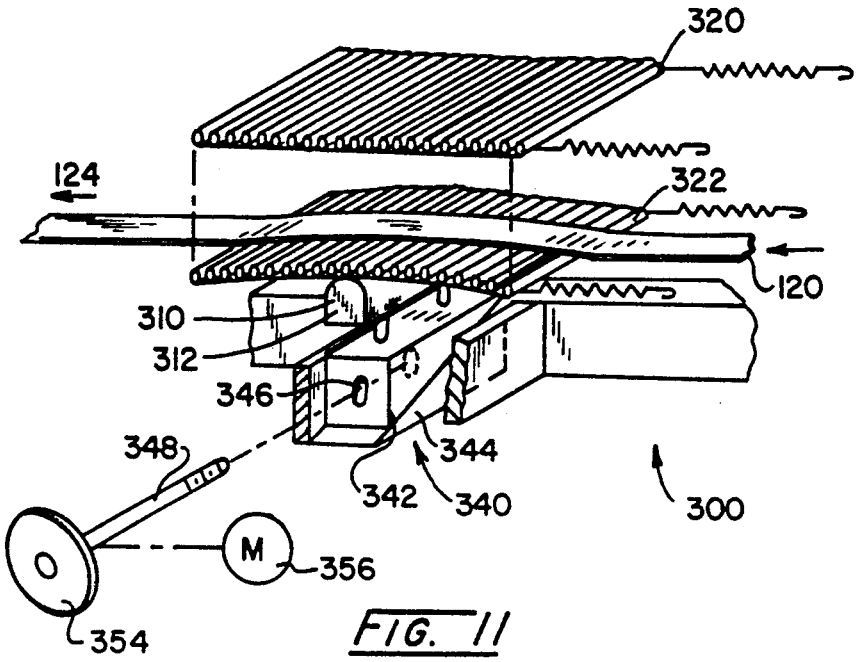
Figure 12:
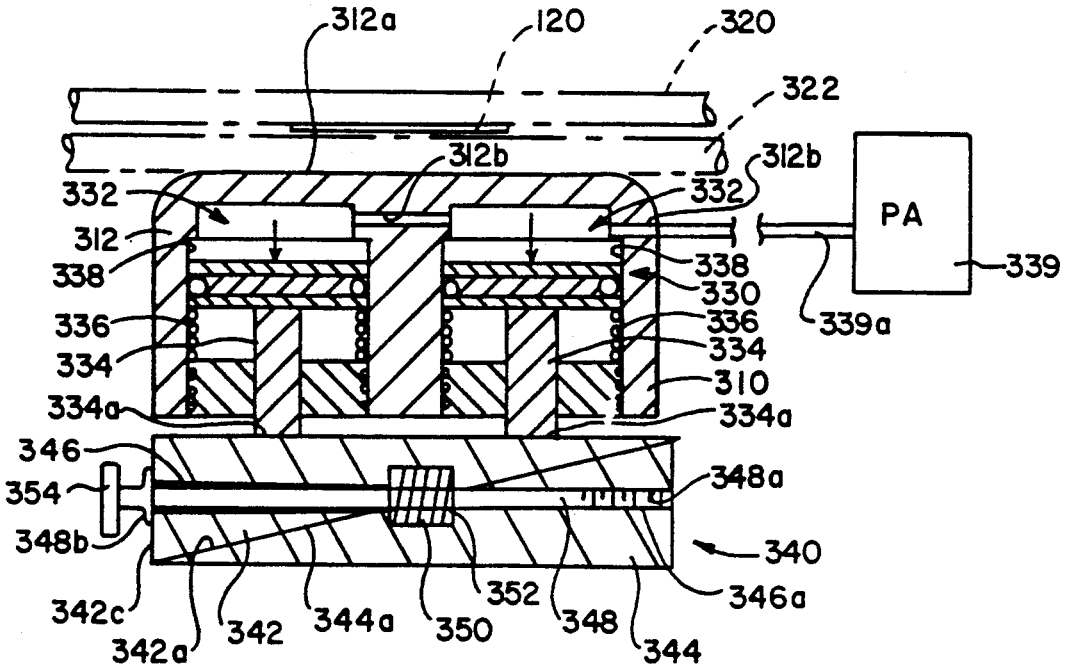
FIG. 12 is a sectioned side view of a lifting bridge, lifting apparatus and height adjustment apparatus shown in FIGS. 10 and 11.

Referring to FIGS. 10–12, the strip adjustment means 300, which acts to adjust successive lengths of movement of the strip 120, will now be described. The strip adjustment means 300 includes a bridge 310 positioned below upper and lower roller chains 320 and 322, respectively, through which the strip 120 passes as it moves along a portion of the path of travel 124. Lifting means 330, see FIG. 12, are associated with the bridge 310 for reciprocally moving the bridge 310 between a lowered position, as shown in FIG. 10, and an elevated position, as shown in FIG. 11. Also provided are height adjustment means 340 positioned below the bridge 310 and the lifting means 330 for adjusting the height of the elevated position of the bridge 310.

The bridge 310 comprises a main body 312 having an upper surface 312a which, when the bridge 312 is in the elevated position, acts to raise the upper and lower roller chains 320 and 322, thereby changing the distance the strip must travel from the feed rollers 110 to the press 112. Housed within the main body 312 of the bridge 310 is the lifting means 330, which comprises a set of pneumatic piston-cylinder units 332. Each unit 332 includes a piston 334 located in a cylinder 338. A spring 336 is also included in each cylinder 338 for biasing the piston 334 in an upward direction therein. A pressurized air supply 339 is provided and communicates with the cylinders 338 through a hose 339a and ducts 312b. Actuation of the pressurized air supply 339 is controlled by the controller 200. When the air supply 339 is actuated, air enters into each cylinder 338 and applies a downwardly directed force upon the pistons 334. This results in the bottom portion 334a of each piston 334 pushing against the height adjustment means 340 and causing the bridge 312 to move to the elevated position.

In the illustrated embodiment, the height adjustment means 340 comprises upper and lower triangular-shaped blocks 342 and 344, respectively, which are positioned so that the hypotenuse side 342a of block 342 is located against the hypotenuse side 344a of block 344. An opening 346 extends through the blocks 342 and 344 for receiving a threaded shaft 348. The shaft 348 includes a threaded portion 348a which threadedly engages with a corresponding threaded portion 346a in the opening 346. The shaft 348 further includes a collar 348b which, when the shaft 348 is turned and threaded into the opening 346, abuts against side 342c of the block 342 and applies an inwardly directed force thereagainst, thereby pushing block 342 upwardly onto the block 344. A recess 350 is also provided in the blocks 342 and 344, into which a compression spring 352, positioned about the shaft 348, is located. The compression spring 352 serves to push block 342 away from block 344 when the shaft 348 is turned and threaded out of the opening 346.

The shaft 346 may include a turn knob 354 for allowing the shaft to be turned manually. Alternatively, the shaft 346 may be connected to a servo-motor 356 which automatically controls the position of the shaft 346 in response to commands received by the controller 200. By turning the shaft 346, either manually or automatically, the height of the elevated position of the bridge 310 can be adjusted so as to vary the distance the strip 120 must travel from the feed rolls 110 to the press 112. Preferably the servo-motor 356 comprises a stepper motor such that appropriate stepped adjustments can be made.

Figure 13:
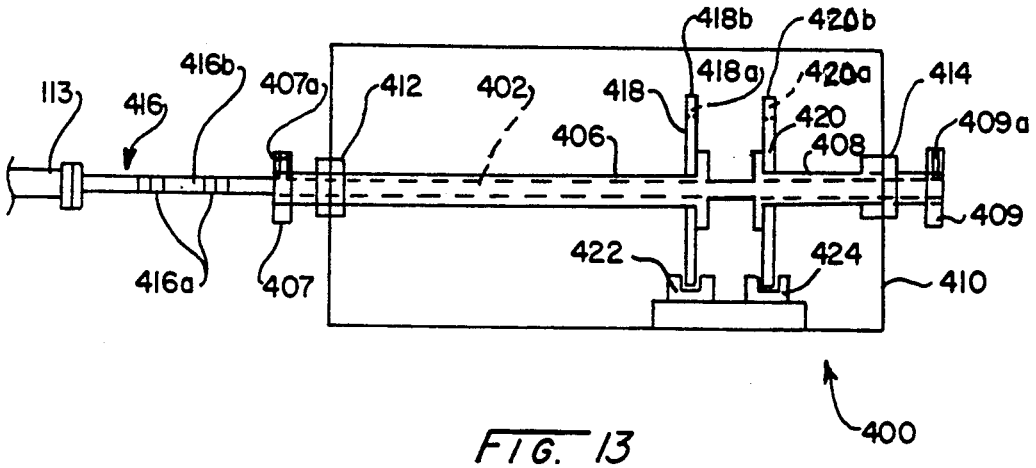
FIG. 13 shows a press crankshaft position indicator usable in the present invention.

Referring now to FIGS. 1 and 13, a crankshaft position indicator 400 is provided and is operatively connected to the crankshaft 113 of the press 112 for providing start of feed (SOF) and end of feed (EOF) signals to the controller 200. The indicator 400 includes a shaft 402 having first and second sleeves 406 and 408 positioned thereon. A housing 410 is provided having first and second bearings 412 and 414, respectively, for rotatably supporting the shaft 402 and the sleeves 406 and 408 therein. The shaft 402 is rotatably connected to the crankshaft 113 of the press 112 by a connector 416 comprising two universal joints 416a and an expandable, i.e., telescopic, interconnecting section 416b. A first rotor 418 having a notch 418a along its peripheral edge 418b is fixedly connected to the first sleeve 406, while a second rotor 420 having a notch 420a along its peripheral edge 420b is fixedly connected to the second sleeve 408. A first photodetector 422 is positioned adjacent to the first rotor 418 and serves to generate a SOF signal to the controller 200 each time the notch 418a passes the photodetector 422. A second photodetector 424 is positioned adjacent to the second rotor 420 and serves to generate an EOF signal to the controller 200 each time the notch 420a passes the photodetector 424.

The position of each rotor 418 and 420 may be adjusted during set-up of the apparatus 100 so as to ensure that the SOF and EOF signals are generated at appropriate times during each cycle of the press 112 An adjustment knob 407 is provided on the sleeve 406 and includes a set screw 407a which extends through the knob 407 and the sleeve 406 for frictionally engaging with the shaft 402. An adjustment knob 409 is likewise provided on the sleeve 408 and includes a set screw 409a which extends through the knob 409 and the sleeve 408 for frictionally engaging with the shaft 402. In order to adjust the position of the rotor 418, the set screw 407a is loosened to permit the sleeve 406 to rotate about the shaft 402. When the rotor 418 is properly positioned on the shaft 402, the set screw 407a is tightened down upon the shaft 402 so as to lock the rotor 418 in position. In order to adjust the position of the rotor 420, the set screw 409a is loosened to permit the sleeve 408 to rotate about the shaft 402. When the rotor 420 is properly positioned on the shaft 402, the set screw 409*a* is tightened down upon the shaft 402 so as to lock the rotor 420 in position.

Figure 14:
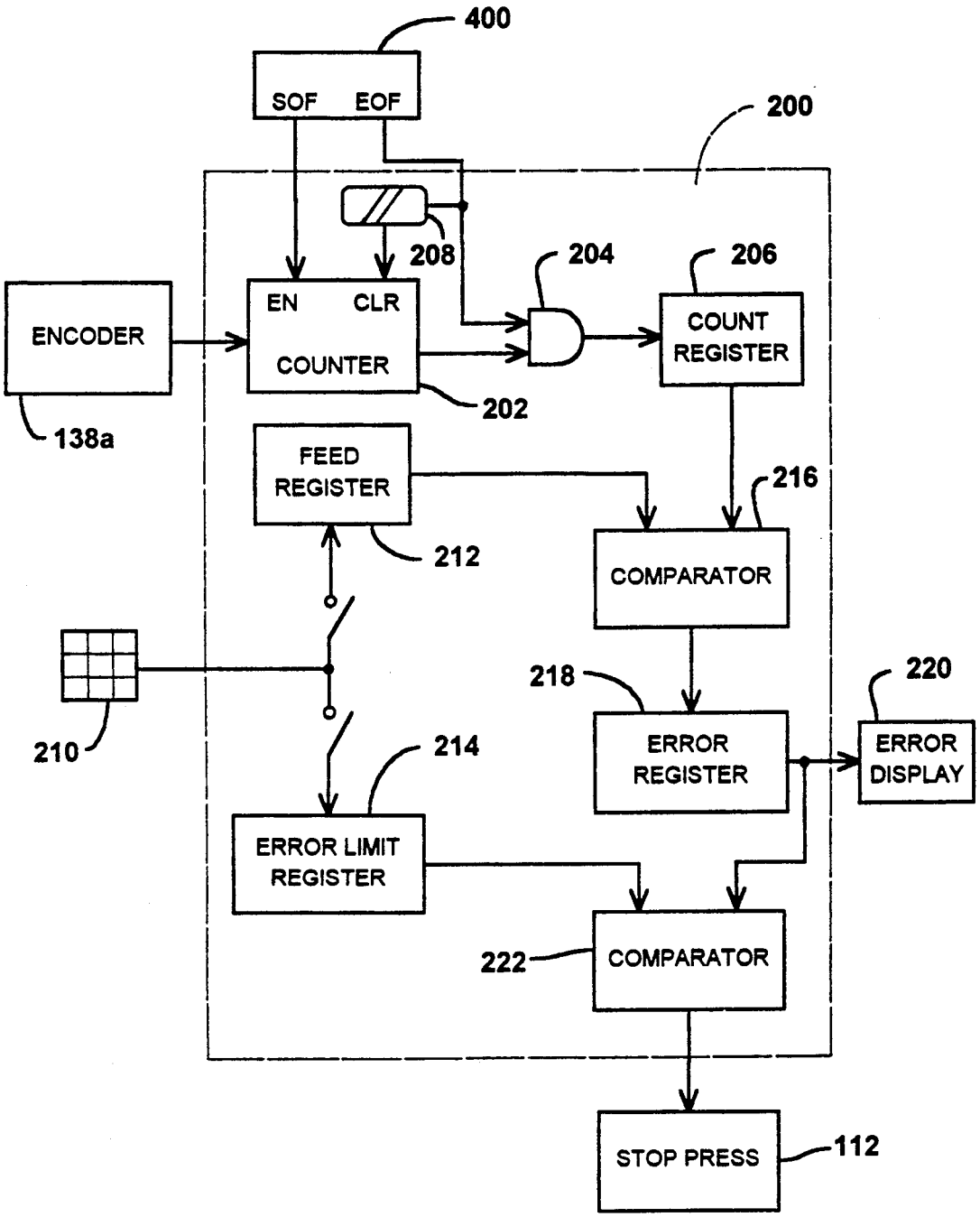
FIG. 14 is a schematic block diagram of circuitry for use in the present invention.

Referring now to FIGS. 1 and 14, the controller 200 according to a first embodiment of the present invention will now be described. The controller 200 includes a counter 202 which is operatively connected to the encoder 138*a* of the strip measuring means 130 and to the crankshaft position indicator 400. The counter 202 is enabled upon receiving the SOF signal generated by the position indicator 400 such that it can count the series of pulses inputted from the encoder 138*a*. The output from counter 202 is gated to a count register 206 as represented by AND gate 204. The crankshaft position indicator 400 is connected to enable the gating of the count from the counter 202 upon generation of the EOF signal. Thus, upon receiving the EOF signal, the count in the counter 202 is gated to the count register 206. A delay element 208 is connected to the counter 202 and the position indicator 400 and serves to clear the counter 202 to prepare it for the next count a predetermined amount of time after receiving the EOF signal from the indicator 400, which delay ensures that the count has been gated into the count register 206.

A keypad 210 is provided on the controller 200 and allows an operator to input the desired feed length of the strip 120 into a feed register 212. The keypad 210 also allows an operator to input a shut-down limit above and below the desired feed length into an error limit register 214. A first comparator 216 is connected to the feed register 212 and to the count register 206. The comparator 216 compares the outputs from the count register 206 and the feed register 212 and generates a length error signal representative of the difference therebetween. The output from the comparator 216 is sent to an error register 218. An error display 220 is connected to the error register and serves to display the length error, which is equal to the difference between the outputs from the count register 206 and the feed register 212.

A second comparator 222 is connected to the error register 218 and to the error limit register 214 and compares the output from the error register 218 with the appropriate shut-down limit generated by the error limit register 214. If the output from the error register 218 exceeds the shut-down limit, the comparator 222 generates a shut-down signal to the press 112, thereby disengaging the clutch 117 and actuating the brake 119 of the press 112 and preventing the upper tooling 114*a* from engaging with the strip material currently in the press 112. If the output from the error register 218 does not exceed the shut-down limit but a length error signal was generated by comparator 216, an operator can correct the next successive length of feed of the strip by manually adjusting the strip adjustment means 300 by turning knob 354.

Figure 15:
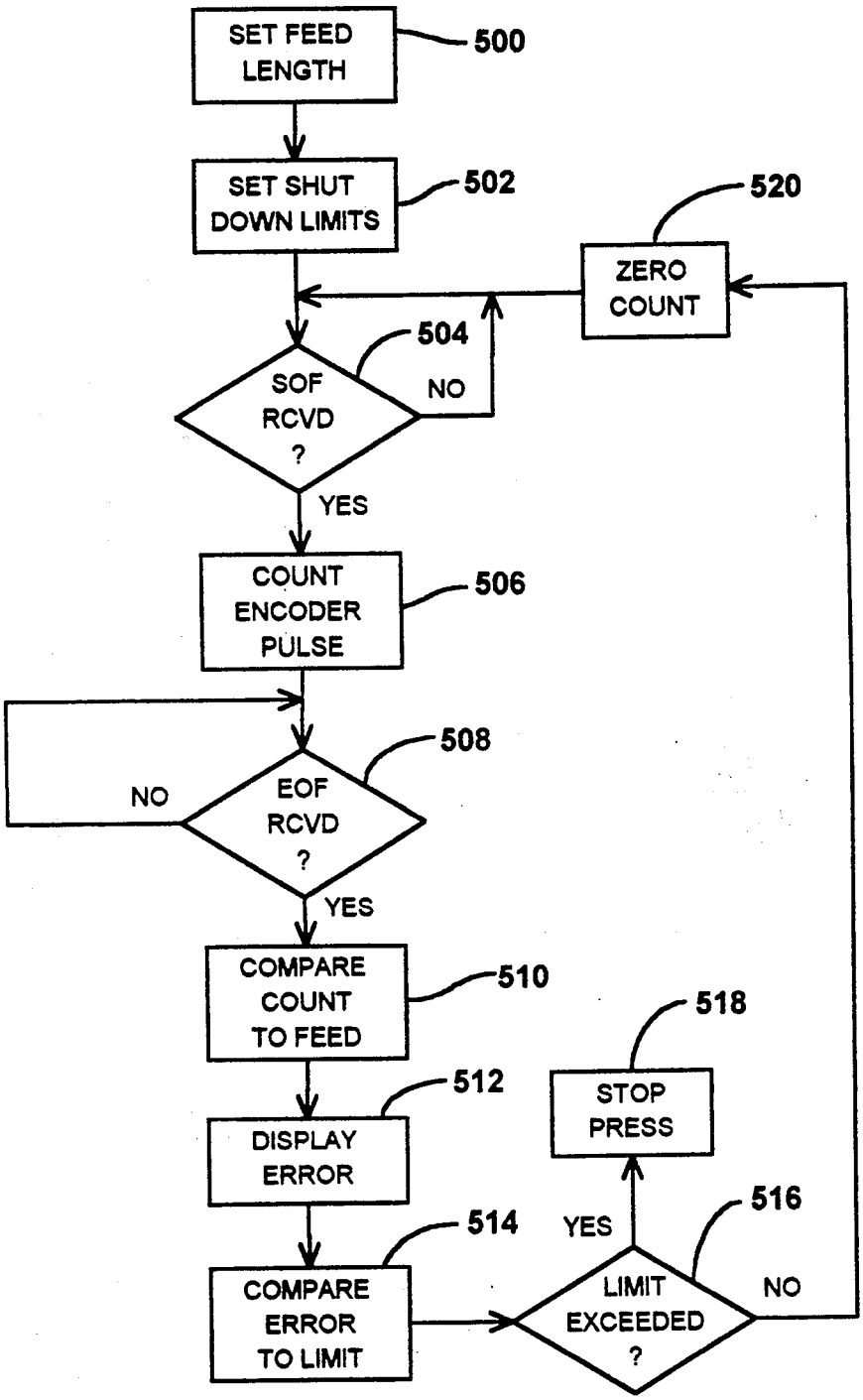
FIG. 15 is a flow chart for performing the present invention via a microprocessor.

It may be preferred to implement the present invention utilizing a microprocessor. To this end, two flow charts are provided in FIGS. 15 and 16 and will now be described. In FIG. 15, the operation of a microprocessor would be initiated and the feed length would be set via a keypad such as the keypad 210 or alternately, see block 500. A shut-down limit range defining permissible limits within which the press can continue to operate would next be set, see block 502. The microprocessor would then await the receipt of a SOF signal from the indicator 400, see block 504. Once the SOF signal is received, the microprocessor counts the pulses generated by the encoder 138*c* until an EOF signal is received from the indicator 400, see blocks 506 and 508. Upon receipt of the EOF signal, the count of the pulses generated by the encoder 138*c* is compared to the feed length that has been previously entered by the operator of the press 112, see block 510. The resulting length error is then displayed and compared to the appropriate shut-down limit which was also previously entered, see blocks 512 and 514. If the length error exceeds the corresponding shut-down limit, the press 112 is shut down as previously described by the generation of a shut-down signal, see blocks 516 and 518. If the length does not exceed the corresponding shut-down limit, the count is zeroed and the process is continued until the shut-down limit range is exceeded or the operation is terminated, see block 520.

Figure 16:
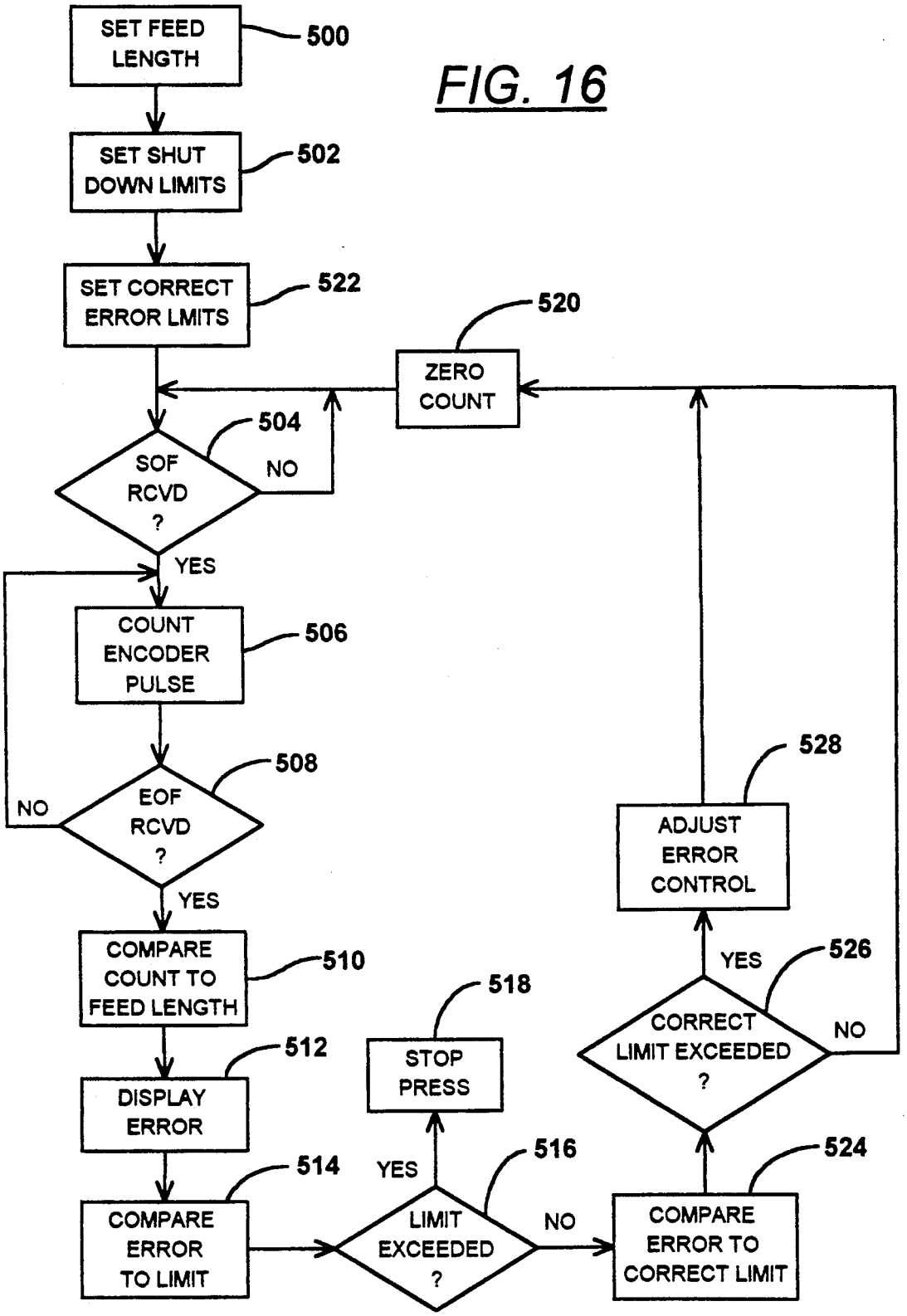
FIG. 16 is a flow chart for performing the present invention including automatic adjustment of the strip feed length via a microprocessor.

FIG. 16 illustrates substantially the same operation of a microprocessor for use in the present invention with the addition of an automatic correction of feed errors for subsequent stock feeds. Accordingly, corresponding blocks will be numbered the same as in FIG. 15 and the description will be limited to this additional feature. In the flow chart of FIG. 16, the operator of the press 112 also sets a correct error limit range which defines a hysteresis region within the shut-down limit range. That is, if the length error signal exceeds one of the correct error limits but does not exceed one of the shut-down limits, succeeding stock feeds will be adjusted. For example, as previously described a stepper motor 356 is stepped in the appropriate direction to correct at least in part for the detected error.

To this end, if the shut down limit range was not exceeded, the length error is next compared to the correct limit range which was previously entered by the operator, see block 524. If the corresponding correct error limit is exceeded, an appropriate step signal, also referred to herein as an error signal, or number of step signals is provided to the stepper motor 356 to at least in part correct succeeding stock feeds, see blocks 526 and 528, and the count is zeroed and operation continues as before, see block 520. The correct error limits define a hysteresis band within which no corrections are made such that the stepper motor 356 is not repeatedly operated back and forth in what is referred to as a "hunting" mode of operation. If the correct error limits are not exceeded, the count is zeroed and operation continues as before.

Figure 17A:
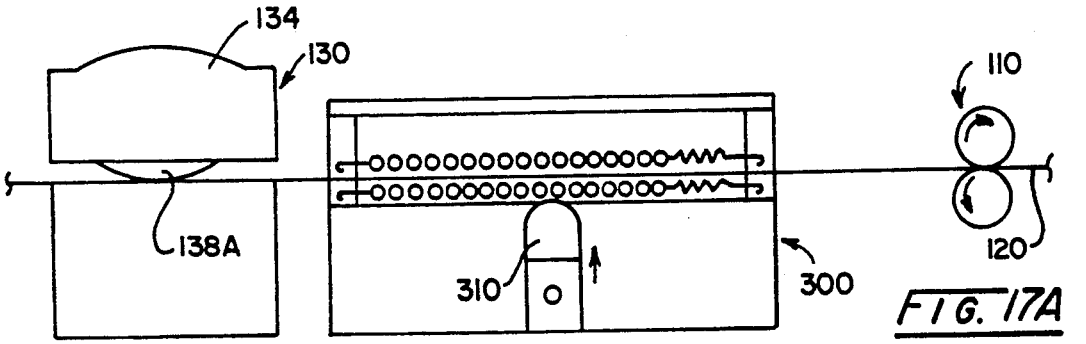
FIGS. 17A-17E show a sequence of operation of the apparatus of FIGS. 1 and 2.
Figure 17B:
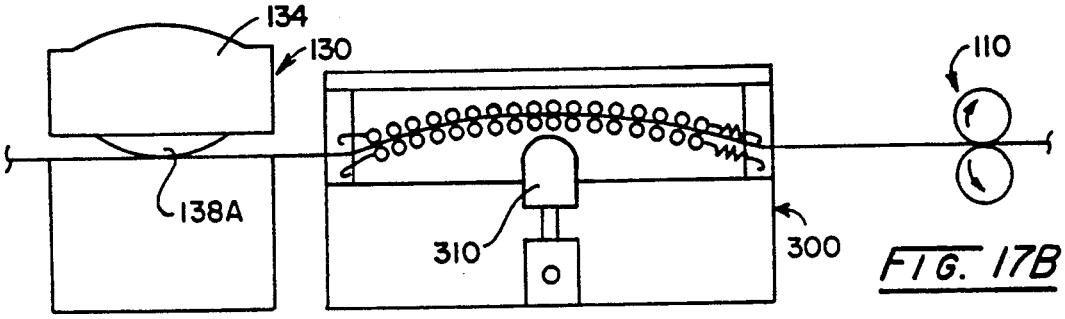

Referring to FIGS. 17A–17E, operation of the measuring and controlling apparatus 100 will now be described. Just before the crankshaft 113 reaches an 8:00 o'clock reference position, the crankshaft position indicator 400 generates the SOF signal. When the crankshaft 113 of the press 112 is at the 8:00 o'clock reference position, the feed rolls 110 begin to feed the strip 120 into the press 112, and the bridge 310 begins to move upwardly from its lowered position, as shown in FIG. 17A. When the crankshaft 113 is at the 12:00 o'clock position, the bridge 310 is at its elevated position, as shown in FIG. 17B.

Figure 17C:
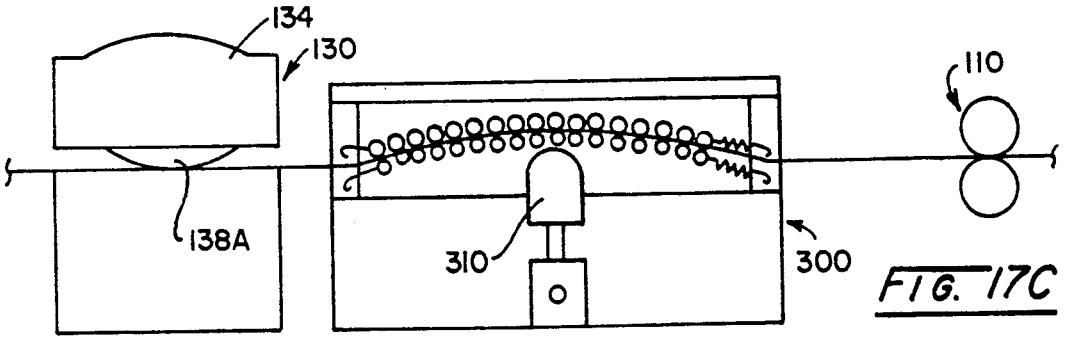

When the crankshaft 113 of the press 112 is at the 2:00 o'clock position, the feed rolls 110 stop rotating, as shown in FIG. 17C, and thereafter the position indicator 400 generates the EOF signal. If the length error exceeds the shut-down limit range, a shut-down signal is generated to the press 112 after the crankshaft 113 reaches the 2:00 o'clock position, thereby preventing damage from occurring to the upper tooling 114*a*. It should be apparent, that damage to the upper tooling 114a will only be prevented if the press 112 is operated at a speed whereby the brake 119 is capable of stopping the slide 114 before the upper tooling 114a reaches the strip 120.

If a length error occurs, and the length error does not exceed the shut-down limit, the next successive length of feed can be corrected manually or automatically by adjusting the height adjustment means 340 of the strip adjustment means 300, as discussed above. It should be apparent, that when the feed length of the feed rolls 110 is initially set, it is set so as to slightly overfeed the strip 120 into the press 112 in order to compensate for the bridge 310 increasing the distance the strip 120 must travel from the feed rolls 110 to the press 112 during each cycle of the press 112.

Figure 17D:
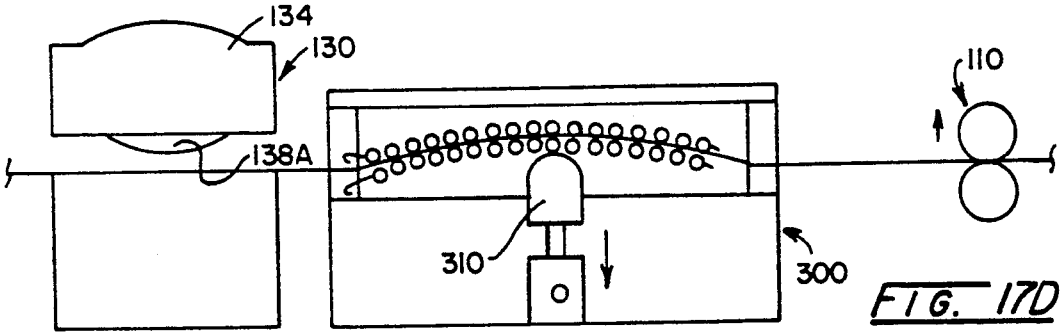
Figure 17E:
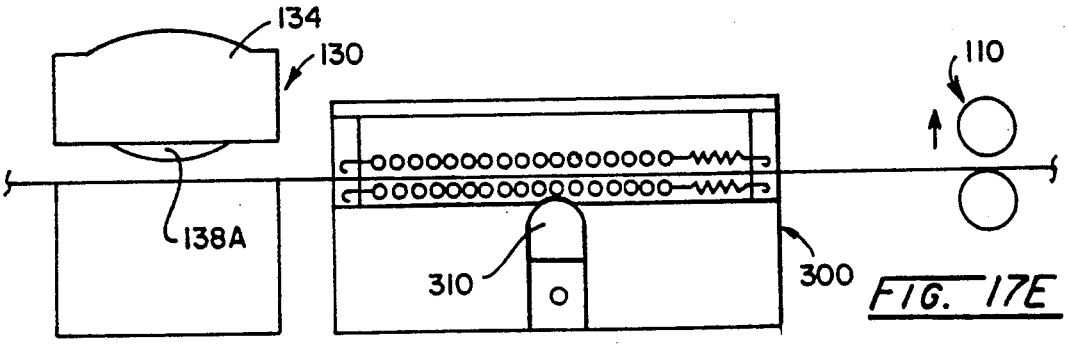

Assuming that a shut-down signal is not generated, the upper tooling 114a engages with the strip 120 just before the crankshaft 113 reaches the 5:00 o'clock position. When the crankshaft 113 does reach the 5:00 o'clock position, the support 134 is moved from the first position to the second position, as shown in FIG. 17D, thereby disengaging the sensing roller 138a from the strip 120. The bridge 310 also begins to fall from its elevated position at this time, and the feed rolls 110 begin to separate from one another. When the crankshaft 113 is at the 6:00 o'clock position, as shown in FIG. 17E, the feed rolls 110 are completely separated from one another, thereby allowing excess strip material positioned between the press 112 and the feed rolls 110 to move in a rearward direction back toward the drum 122. The support 134 returns to the first position when the slide 114 moves to it upper position so as to reset roller 138a on the strip 120. This occurs when the crankshaft is at the 7:30 o'clock position.

Having described the invention in detail and by reference to preferred embodiments thereof, it will be apparent that modifications and variations are possible without departing from the scope of the invention as defined in the appended claims.

What is claimed is:

1. An apparatus for measuring the movement of a continuous intermittently advanced stock material strip, comprising:

a base having a guide surface over which said strip travels;

a support positioned adjacent to said base and movable relative thereto;

reciprocating means associated with said support for reciprocally moving said support between a first position adjacent to said guide surface and a second position away from said guide surface, said reciprocating means comprising:

a cam having a first pin fixedly connected thereto and an outer camming surface on its outer periphery, said cam being pivotably connected to said support via a second pin;

roller means associated with said base for engaging with said outer camming surface of said cam; and actuating means for acting upon said first pin to rotate said cam about said second pin thereby causing said outer camming surface to travel over said roller means to reciprocally move said support between said first and second positions; and rotatable sensor mounted to said support for sensing the movement of said strip, said rotatable sensor means engaging said strip for sensing strip movement when said support is in said first position and being removed from said strip when said support is in said second position.

2. An apparatus as set forth in claim 1, wherein said roller means comprises:

a first roller rotatably mounted to a shaft; and a housing having first and second outer surfaces, and an opening for receiving said first roller, said shaft being mounted within said opening so that said first roller extends out from said first surface an amount greater than it extends out from said second surface.

3. An apparatus as set forth in claim 1, wherein said base includes a first recess for removably receiving said roller means.

4. An apparatus as set forth in claim 1, wherein said actuating means comprises a bar slidably positioned in a second recess in said support for reciprocating movement therein, said bar having a slot for receiving said first pin, said slot acting upon said first pin to rotate said cam about said second pin when said bar reciprocates in said second recess.

5. An apparatus as set forth in claim 1, wherein said base includes a guide roller which extends above said guide surface for engaging said strip as it travels over said guide surface.

6. An apparatus as set forth in claim 5, wherein said rotatable sensor means includes a sensing roller which engages with said strip, said sensing roller and said guide roller being positioned diametrically opposite to one another and being forced apart by said strip as it passes therebetween.

7. An apparatus as set forth in claim 1, wherein said rotatable sensor means comprises:

a sensing roller for engaging and rotating with said strip when said support is in said first position;

encoder means associated with said sensing roller for generating a series of pulses which are representative of movement of said strip; and counter means for counting said pulses to accumulate a count representative of the movement of said strip.

8. An apparatus as set forth in claim 7, wherein said sensing roller has a knurled outer peripheral surface.

9. An apparatus as set forth in claim 1, further comprising resilient biasing means for biasing said support toward said base.

10. An apparatus for measuring and controlling lengths of movement of a continuous stock material strip which is intermittently fed by feed rollers along a predetermined path of travel to a machine which is provided with a crankshaft for reciprocally operating a carriage having operation means for acting upon said strip, said apparatus comprising:

crankshaft position indicator means operatively connected to said crankshaft for generating start of feed and end of feed signals;

strip measuring means for engaging with and sensing movement of said strip and generating a strip movement signal representative of the movement of said strip;

controller means for receiving said strip movement signal from said strip measuring means and said start of feed and end of feed signals from said crankshaft position indicator means and generating therefrom a first signal indicative of a length of movement of said strip occurring between start of feed and end of feed signals, and comparing said first signal to a second signal representative of a predetermined desired length of movement of said strip, said controller means generating a shut-down signal to said machine if the difference between said first and second signals exceeds a predetermined shut-down limit range and generating an error signal if the difference between said first and second signals does not exceed said shut-down limit range but exceeds a predetermined error limit range; and strip adjustment means connected to said controller means and responsive to said error signal for adjusting the next successive length of movement of said strip based upon said error signal, said strip adjustment means comprising:

a bridge positioned below said path of travel of said strip and being movable toward and away from said strip;

lifting means associated with said bridge for reciprocally moving said bridge between a lowered position and an elevated position, said bridge raising said strip as it moves from its lowered position to its elevated position; and height adjustment means positioned adjacent to said bridge and lifting means for adjusting the height of said bridge and said lifting means in response to said error signal, thereby changing the distance said strip must travel from said feed rollers to said machine.

11. An apparatus as set forth in claim 10, wherein said controller means further includes means for inputting said shut-down limit range and said error limit range.

12. An apparatus as set forth in claim 10, wherein said strip measuring means comprises:

a sensing roller for engaging and rotating with said strip along a section of said predetermined path of travel of said strip; and encoder means associated with said sensing roller for generating a series of pulses representative of the length of movement of said strip, said series of pulses comprising said strip movement signal.

13. An apparatus for measuring and controlling lengths of movement of a continuous stock material strip which is intermittently fed by feed rollers along a predetermined path of travel to a machine which is provided with a crankshaft for reciprocally operating a carriage having operation means for acting upon said strip, said apparatus comprising:

crankshaft position indicator means operatively connected to said crankshaft for generating start of feed and end of feed signals;

strip measuring means for sensing movement of said strip and generating a strip movement signal representative of the movement of said strip;

controller means for receiving said strip movement signal from said strip measuring means and said start of feed and end of feed signals from said crankshaft position indicator means and generating therefrom a first signal indicative of a length of movement of said strip occurring between start of feed and end of feed signals, and comparing said first signal to a second signal representative of a predetermined desired length of movement of said strip, said controller means generating a shut-down signal to said machine if the difference between said first and second signals exceeds a predetermined shut-down limit range, thereby shutting down said machine and preventing damage from occurring to said operation means before said operation means acts upon said strip, said controller means further including display means for displaying a length error equal to the difference between said first and second signals; and strip adjustment means for correcting successive lengths of movement of said strip, said strip adjustment means being manually adjustable in response to the displayed length error, said strip adjustment means comprising:

a bridge positioned below said path of travel of said strip and being movable toward and away from said strip;

lifting means associated with said bridge for reciprocally moving said bridge between a lowered position and an elevated position, said bridge raising said strip as said bridge moves from its lowered position to its elevated position; and height adjustment means associated with said bridge and said lifting means for adjusting the height of said bridge and said lifting means, said height adjustment means being manually adjustable in response to the displayed length error, thereby changing the distance said strip must travel from said feed rollers to said machine.

14. An apparatus for measuring and controlling lengths of movement of a continuous stock material strip which is intermittently fed by feed rollers along a predetermined path of travel to a machine which is provided with a crankshaft for reciprocally operating a carriage having operation means for acting upon said strip, said apparatus comprising:

crankshaft position indicator means operatively connected to said crankshaft for generating start of feed and end of feed signals;

strip measuring means for sensing movement of said strip and generating a strip movement signal representative of the movement of said strip;

controller means for receiving said strip movement signal from said strip measuring means and said start of feed and end of feed signals from said crankshaft position indicator means and generating therefrom a first signal indicative of a length of movement of said strip occurring between start of feed and end of feed signals, and comparing said first signal to a second signal representative of a predetermined desired length of movement of said strip, said controller means generating a shut-down signal to said machine if the difference between said first and second signals exceeds a predetermined shut-down limit range, thereby shutting down said machine and preventing damage from occurring to said operation means before said operation means acts upon said strip, said controller means further generating an error signal if the difference between said first and second signals does not exceed said shut-down limit range but exceeds a predetermined error limit range; and strip adjustment means for correcting the next successive length of movement of said strip based upon said error signal, said strip adjustment means comprising:

a bridge positioned below said path of travel of said strip and being movable toward and away from said strip;

lifting means associated with said bridge for reciprocating said bridge between a down position and an elevated position, said bridge raising said strip as said bridge moves from its down position to its elevated position; and height adjustment means associated with said bridge and lifting means for adjusting the height of said bridge and said lifting means in response to said error signal, thereby changing the distance said strip must travel from said feed rollers to said machine.

* * * * *

UNITED STATES PATENT AND TRADEMARK OFFICE

CERTIFICATE OF CORRECTION

PATENT NO. : 5,310,105

DATED : May 10, 1994

INVENTOR(S) : William Dennis Mills

It is certified that error appears in the above-indentified patent and that said Letters Patent is hereby corrected as shown below:

Col. 11, line 66, "sensor mounted" should be --sensor means mounted--.

Signed and Sealed this

Sixteenth Day of August, 1994

*Attest:*

*Attesting Officer*

Bruce Lehman

BRUCE LEHMAN

*Commissioner of Patents and Trademarks*